US011760607B2

(12) United States Patent
Cambruzzi et al.

(10) Patent No.: US 11,760,607 B2
(45) Date of Patent: Sep. 19, 2023

(54) MOUNTING SYSTEM FOR PERFORMING AN INSTALLATION OPERATION IN AN ELEVATOR SHAFT OF AN ELEVATOR SYSTEM

(71) Applicant: Inventio AG, Hergiswil (CH)

(72) Inventors: Andrea Cambruzzi, Zürich (CH); Eliza Olczyk, Lucerne (CH); Oliver Simmonds, Lucerne (CH); Philipp Zimmerli, Harkingen (CH); Raphael Bitzi, Lucerne (CH)

(73) Assignee: INVENTIO AG, Hergiswil (CH)

( * ) Notice: Subject to any disclaimer, the term of this patent is extended or adjusted under 35 U.S.C. 154(b) by 379 days.

(21) Appl. No.: 17/250,711

(22) PCT Filed: Aug. 9, 2019

(86) PCT No.: PCT/EP2019/071398
§ 371 (c)(1),
(2) Date: Feb. 23, 2021

(87) PCT Pub. No.: WO2020/048727
PCT Pub. Date: Mar. 12, 2020

(65) Prior Publication Data

US 2021/0323793 A1 Oct. 21, 2021

(30) Foreign Application Priority Data

Sep. 3, 2018 (EP) ..... 8192228

(51) Int. Cl.
*B66B 19/00* (2006.01)

(52) U.S. Cl.
CPC ..... *B66B 19/00* (2013.01)

(58) Field of Classification Search
CPC ..... B66F 19/00
See application file for complete search history.

(56) References Cited

U.S. PATENT DOCUMENTS

| | | | |
|---|---|---|---|
| 2010/0018811 | A1 | 1/2010 | Vaudo et al. |
| 2014/0246274 | A1 | 9/2014 | Ach |
| 2018/0215588 | A1 | 8/2018 | Butler et al. |

FOREIGN PATENT DOCUMENTS

| | | | |
|---|---|---|---|
| CN | 1509975 | A | 7/2004 |
| CN | 201224646 | Y | 4/2009 |

(Continued)

*Primary Examiner* — Nirvana Deonauth
(74) *Attorney, Agent, or Firm* — William J. Clemens; Shumaker, Loop & Kendrick, LLP

(57) ABSTRACT

A mounting system for performing an installation operation in an elevator shaft of an elevator system has a mounting apparatus that includes a carrier component with a mechatronic installation component, a displacement component, a suspension cable and a deflection roller deflecting the suspension cable between the displacement component and the carrier component. The carrier component is supported against a supporting wall of the elevator shaft by an upper support roller, at least during displacement in the elevator shaft. The suspension cable has, between the deflection roller and the carrier component, a diagonal pull relative to the vertical in the direction of the supporting wall and is guided via the deflection roller such that the diagonal pull can be varied by displacing the deflection roller. The deflection roller is arranged via a holding apparatus on a surface of the supporting wall such that the deflection roller protrudes into the elevator shaft.

14 Claims, 6 Drawing Sheets

(56) References Cited

FOREIGN PATENT DOCUMENTS

| | | | | | |
|---|---|---|---|---|---|
| CN | 101528582 | A | | 9/2009 | |
| CN | 201882736 | U | | 6/2011 | |
| CN | 102264624 | A | | 11/2011 | |
| CN | 202897730 | U | | 4/2013 | |
| CN | 104671031 | A | | 6/2015 | |
| DE | 1198972 | B | | 8/1965 | |
| EP | 3323762 | A1 | | 5/2018 | |
| WO | 2012035481 | A1 | | 3/2012 | |
| WO | 2015102525 | A1 | | 7/2015 | |
| WO | WO-2017016780 | A1 | * | 2/2017 | ..... B66B 11/00 |
| WO | 2018162350 | A1 | | 9/2018 | |

* cited by examiner

MOUNTING SYSTEM FOR PERFORMING AN INSTALLATION OPERATION IN AN ELEVATOR SHAFT OF AN ELEVATOR SYSTEM

FIELD

The invention relates to a mounting system for performing an installation operation in an elevator shaft of an elevator system.

BACKGROUND

The international patent application with the application number PCT/EP2018/055189 (WO 2018/162350 A1) describes a mounting system for performing an installation operation in an elevator shaft of an elevator system. The mounting system described therein has a mounting apparatus with a carrier component and a mechatronic installation component, a displacement component arranged above the mounting apparatus and a suspension means which is fixed at least indirectly to the carrier component. The displacement component can displace the carrier component and thus the mounting apparatus in the elevator shaft by means of the suspension means, wherein the carrier component can be supported on a supporting wall of the elevator shaft via an upper support roller at least during displacement in the elevator shaft. The suspension means of the mounting system has a diagonal pull with respect to the vertical in the direction of the supporting wall of the elevator shaft. In an exemplary embodiment of the mounting system according to the above-mentioned international patent application, the suspension means is deflected between the displacement component and the carrier component by a deflection roller located outside the elevator shaft.

SUMMARY

It is an object the invention to propose a mounting system for performing an installation operation in an elevator shaft of an elevator system which enables adjusting said diagonal pull in a simple manner.

The mounting system according to the invention for performing an installation operation in an elevator shaft of an elevator system has a mounting apparatus which has a carrier component and a mechatronic installation component, a displacement component which is arranged above the mounting apparatus, a suspension means which is fixed at least indirectly to the carrier component and a deflection roller for deflecting the suspension means between the displacement component and the carrier component. The displacement component can displace the mounting apparatus in the elevator shaft by means of the suspension means. The carrier component is supported on a supporting wall of the elevator shaft via an upper support roller, at least during displacement in the elevator shaft. In particular, the carrier component is only supported on the supporting wall and not additionally on a shaft wall of the elevator shaft opposite the supporting wall. Between the deflection roller and the carrier component, the suspension means has a diagonal pull with respect to the vertical in the direction of the supporting wall of the elevator shaft and is guided via the deflection roller in such a way that said diagonal pull can be changed by means of a displacement of the deflection roller. According to the invention, the deflection roller is arranged on a boundary surface of the elevator shaft via a holding apparatus in such a way that it protrudes into the elevator shaft.

The arrangement according to the invention of the deflection roller allows an installer to easily mount the deflection roller from a position within the elevator shaft such that the suspension means has a desired diagonal pull. Mounting the deflection roller is possible in a simple and safe manner, in particular if an installation platform is arranged in an upper region of the elevator shaft such that an installer can install the deflection roller from the installation platform. Such installation platforms are usually present when installing elevator systems with a relatively high number of floors and can therefore also be used for the installation of the deflection roller.

An elevator shaft usually has a rectangular cross-section and has a shaft ceiling, a shaft floor and shaft walls connecting the shaft ceiling and the shaft floor. Several elevator shafts can be arranged side by side without any partition walls between the individual shafts. Thus, an elevator shaft has at least two shaft walls facing each other. At least one of these two shaft walls has door openings. Shaft ceiling, shaft floor and shaft walls are boundary surfaces of the elevator shaft.

An arrangement of the deflection roller via a holding apparatus is to be understood here as meaning that the holding apparatus is fixed to a boundary surface, in particular is screwed to the boundary surface by means of at least one screw, and that the deflection roller is held by the holding apparatus. Since the deflection roller protrudes into the elevator shaft, it is also arranged within the elevator shaft.

A diagonal pull of the suspension means between the deflection roller and the carrier component is understood in this context to mean that the suspension means between the deflection roller and the carrier component does not run exactly perpendicularly or vertically downwards, but is inclined with respect to the perpendicular or vertical. A diagonal pull between the deflection roller and the carrier component in the direction of the supporting wall of the elevator shaft is understood here to mean that the suspension means runs inclined in the direction of the supporting wall in such a way that it has a smaller distance to the supporting wall in the region of the deflection roller than in the region of the connection to the carrier component. A distance of the suspension means in the region of the deflection roller with respect to a perpendicular or vertical line through the connection of the suspension means to the carrier component is, for example, between 20 and 60 cm, in particular between 35 and 52 cm. Thus, a vertical distance between deflection roller and carrier component of 100 m results in a diagonal pull of, for example, between approx. 0.115 and 0.344°, in particular between approx. 0.2 and 0.3°. It is possible that the suspension means has, in addition, a diagonal pull in another direction. The angle to the vertical is a measure for the diagonal pull; thus, the greater the angle, the greater the diagonal pull. The mentioned angle amounts to a maximum of 15°, for example. A holding force which acts on the carrier component via the suspension means and which is introduced into the carrier component at a force transmission point thus has a horizontal component in the direction of the supporting wall in addition to a vertical component. This horizontal component of the holding force causes a horizontal reaction force in the opposite direction at the deflection roller. The carrier component is therefore not only held in the vertical direction by the suspension means but is also pulled towards the supporting wall so that the upper support roller is always in contact with the supporting wall.

By providing the above-mentioned diagonal pull of the suspension means, it is possible to safely prevent the upper support roller from lifting off from the supporting wall and thus to prevent the carrier component and thus the mounting apparatus from hanging and swinging freely. Moreover, this also prevents the mounting apparatus from hitting against a shaft wall and thus damage to the mounting apparatus and/or the shaft walls is prevented. In this way, the mounting system according to the invention ensures safe and damage-free displacement of the mounting apparatus in the elevator shaft.

The suspension means is guided via the deflection roller in such a way that the diagonal pull can be changed by means of displacement, thus change of position of the deflection roller. The deflection roller thus deflects the suspension means such that the suspension means between the displacement component and the deflection roller has a different course with respect to the supporting wall than between the deflection roller and the carrier component. The position of the deflection roller determines the difference between the two courses. By adjusting the position of the deflection roller, thus by displacing the deflection roller in horizontal and/or vertical direction, the diagonal pull can thus be changed and therefore adjusted. The position of the deflection roller can remain constant or can change during an installation operation, thus even in the case of displacement of the mounting apparatus in the elevator shaft.

The installation component of the mounting apparatus is held on the carrier component and is designed to perform a mounting step within the installation operation at least partially automatically, preferably fully automatically. The installation component should be a mechatronic one, that is, should have interacting mechanical, electronic and information technology elements or modules.

In particular, the mounting apparatus may be designed corresponding to a mounting apparatus described in WO 2017/016783 A1.

The feature that the displacement component is arranged above the mounting apparatus in the elevator shaft refers to a functional condition of the mounting system. In this condition, the mounting system is mounted in an elevator shaft in such a way that the carrier component and thus the mounting apparatus can be displaced in the elevator shaft. The displacement component can be arranged in the elevator shaft or above the elevator shaft.

The displacement component can be designed, for example, as a kind of cable winch, in which the suspension means can be wound up, for example, in the form of a flexible cable or chain onto a winch driven by an electric motor.

In particular, the carrier component has a pair of upper support rollers which are arranged horizontally next to each other when the mounting system is in functional condition. In addition to the upper support roller or rollers, the carrier component has in particular also a lower support roller or a pair of lower support rollers by means of which the carrier component is additionally supported in the elevator shaft on the supporting wall of the elevator shaft, at least during displacement. In the above-mentioned functional condition of the mounting system, the lower support rollers are arranged below the upper support rollers. When tilting the carrier component about the upper support roller towards the supporting wall, the lower support rollers lift off from the supporting wall.

The supporting wall, on which the carrier component is supported during displacement in the elevator shaft, is one of the above-mentioned shaft walls of the elevator shaft. Therefore, no additional supporting wall is required. In particular, the shaft wall that is located opposite the door cut-outs for shaft doors of the elevator system is selected as the supporting wall. This means that the installation system can also be used when several elevator shafts which are not separated by shaft walls are arranged next to each other.

A deflection roller is to be understood here as a roller that can rotate about an axis of rotation and has a mainly disk-shaped basic shape. Said axis of rotation is supported in the holding apparatus. In particular, the deflection roller is not driven, but is set in rotation only by the suspension means guided over it when the mounting apparatus is displaced in the elevator shaft.

The deflection roller is fixed to a shaft wall of the elevator shaft in particular via the holding apparatus. The shaft wall mentioned above is in particular the supporting wall, wherein it is in particular also possible that the fixing is carried out to a shaft wall opposite the supporting wall. Fixing the deflection roller to the shaft wall by means of the holding device allows a particularly simple installation of the deflection roller. As an alternative, the deflection roller can also be fixed to the shaft ceiling of the elevator shaft via the holding apparatus.

In an embodiment of the invention, at least part of the holding apparatus is arranged on the boundary surface of the elevator shaft, thus in particular on the supporting wall, to be pivotable about a pivot axis. Said pivot axis runs mainly horizontally and parallel to the mentioned boundary surface of the elevator shaft, thus in particular to the supporting wall. At least the mentioned part of the holding apparatus is thus pivoted in the vertical direction when forces occur and can thus deflect. This means that the holding apparatus does not have to be designed to be rigid to such an extent that it can absorb all forces occurring in the vertical direction, which can be generated, for example, by friction between the suspension means and the deflection roller. The holding apparatus can thus be manufactured with comparatively little material which, on the one hand, makes it cost-effective and, on the other, lightweight. A lightweight holding apparatus is particularly easy to install in the elevator shaft.

The holding apparatus includes in particular a fixing part and a pivot arm. The fixing part is provided to be fixed, in particular screwed, to the boundary surface of the elevator shaft. The deflection roller is arranged on the pivot arm and the pivot arm is pivotable with respect to the fixing part. The pivot arm and the fixing part are connected in particular by means of a bolt, which at the same time forms the pivot axis about which the pivot arm can be pivoted with respect to the fixing part.

By providing at least two components in the holding apparatus, the installation of the holding apparatus in the elevator shaft is particularly easy. In particular, during the installation, first the fixing part is fixed by means of screws to the boundary surface of the elevator shaft, thus in particular to the supporting wall. The fixing part can be configured to be particularly compact and thus also light, which makes fixing easy. Subsequently, the pivot arm is fixed to the fixing part, in particular by means of a bolt. For this purpose, the fixing part has at least one recess through which the bolt can be inserted. Finally, the bolt is secured with a safety pin, for example.

In an embodiment of the invention, the displacement component is suspended from a shaft ceiling of the elevator shaft. This makes it particularly easy to arrange the displacement component in the elevator shaft. This is in particular true if the installation platform described above is available. For the suspension of the displacement component, suitable suspension devices can already be provided on the shaft ceiling during the construction of the elevator shaft.

In an embodiment of the invention, a suspension point of the suspension means on the carrier component is arranged exactly above a center of gravity of the mounting apparatus. This enables a particularly safe and stable displacement of the mounting apparatus in the elevator shaft.

In an embodiment of the invention, the mounting system has a compensating element which is designed and arranged in such a way that it counteracts tilting of the carrier component about the upper support roller towards the supporting wall during displacement of the carrier component in the elevator shaft. Therefore, tilting of the mounting apparatus about the upper support roller when an initial distance between the deflection roller and the mounting apparatus decreases, thus when the mounting apparatus is displaced upwards towards the deflection roller and the displacement component, can effectively prevented.

The mentioned horizontal component of the holding force in the direction of the supporting wall causes a torque around the upper support roller. If this torque is too high, the carrier component can tilt about the upper support roller towards the supporting wall, wherein the upper part of the carrier component rotates towards the supporting wall, thereby increasing the distance between the lower part and the supporting wall. In the case of such a tilting of the carrier component, there is in turn a risk of the mounting apparatus colliding with a shaft wall and thus the risk of damaging the mounting apparatus and/or the elevator shaft.

The above-mentioned horizontal component of the holding force and thus the torque around the upper support roller mainly depends on the diagonal pull in the direction of the supporting wall and increases in particular with increasing diagonal pull. Without a suitable countermeasure, the diagonal pull of the suspension means in the direction of the shaft wall changes during displacement of the carrier component. Without a suitable countermeasure, the diagonal pull and thus the horizontal component of the holding force in the direction of the supporting wall, as well as the torque around the upper support roller, therefore increase with a reduction of the first distance between displacement component and carrier component or mounting apparatus. The compensating element of the mounting system can counteract the tilting of the carrier component around the upper support roller in different ways, which are described in connection with further embodiments of the invention.

During a displacement of the mounting apparatus in the elevator shaft, the combination of diagonal pull of the suspension means with respect to the vertical in the direction of the supporting wall and the compensating element prevents, on the one hand, the upper supporting roller and thus the carrier component from lifting off from the supporting wall and, on the other hand, the carrier component from tilting about the upper supporting roller in the direction of the supporting wall, which both can result in the mounting apparatus hitting against a shaft wall of the elevator shaft.

In an embodiment of the invention, the compensating element is configured and arranged such that it counteracts an increase in the diagonal pull of the suspension means when the first distance between the displacement component and the mounting apparatus decreases. Since, as described above, with increasing diagonal pull, the shear force acting on the carrier component increases in the direction of the supporting wall, an at least less strong increase of the diagonal pull counteracts an increase of the shear force and thus an increase of the torque around the upper support roller. Tilting of the carrier component and thus of the mounting apparatus when the first distance between the displacement component and mounting apparatus decreases, thus when the mounting apparatus is pulled up in the elevator shaft, is thereby effectively prevented. The above-mentioned less strong increase of the diagonal pull mentioned refers to a course of the diagonal pull that would occur in the case of a mounting system without a compensating element. Compared to a diagonal pull at the beginning of a lifting, the diagonal pull can remain the same during the lifting, increase only slightly or even become smaller.

In an embodiment of the invention, the compensating element is arranged on the holding apparatus and is configured and arranged in such a way that it counteracts an increase in the diagonal pull of the suspension means when the first distance between the deflection roller and the carrier component and thus the mounting apparatus decreases. Thus, tilting of the mounting apparatus around the upper support roller when the first distance decreases, thus, when the mounting apparatus is displaced upwards towards the deflection roller and the displacement component, can be effectively prevented.

In an embodiment of the invention, the compensating element is arranged and configured in such a way that it increases a second distance between the deflection roller and the supporting wall when the first distance between the deflection roller and the carrier component and thus the mounting apparatus decreases. For this purpose, in particular, the axis of rotation of the deflection roller can be moved with respect to the holding apparatus. The holding apparatus includes, for example, a slotted hole which is oriented mainly perpendicular to the supporting wall and in which the axis of rotation of the deflection roller can be moved.

The increase in the second distance counteracts the increase in the diagonal pull, which, as described above, at least results in a less strong increase of the shear force towards the supporting wall. The arrangement of the compensating element at the holding apparatus has the advantage over an arrangement at the carrier component that it does not have to be arranged at the carrier component and therefore does not require any installation space at the carrier component and in particular does not increase the weight of the mounting apparatus.

The compensating element includes in particular a spring which is configured and arranged in such a way that it applies a force to the deflection roller in the direction of the supporting wall. For example, the spring is configured as a coil spring and acts in particular on the axis of rotation of the deflection roller and presses it towards the supporting wall. Thus, the compensating element is constructed in a particularly simple and cost-effective manner.

The above-described reaction force, which is oriented away from the supporting wall, to the horizontal holding force for the carrier component counteracts the force of the spring mentioned above. The greater the horizontal component of the holding force and thus the reaction force, the more the spring is compressed and thus the deflection roller is pushed away from the supporting wall. The reaction force increases almost linearly over a wide range of displacement as long as the aforementioned first distance between support roller and carrier component is large enough. By choosing a spring with a suitable spring constant, an almost constant diagonal pull can be guaranteed when the mounting apparatus is displaced in the mentioned range.

In an embodiment of the invention, the compensating element is arranged on the carrier component and configured in such a way that, when the first distance between the deflection roller and the mounting apparatus decreases, it decreases a third distance of a suspension element of the carrier component, via which the carrier component is connected to the suspension means, to the supporting wall. The suspension element is in particular arranged to be displaceable with respect to the carrier component in a direction perpendicular to the supporting wall. Decreasing the third distance counteracts the increase in the diagonal pull of the suspension means in the direction of the supporting wall, which, as described above, at least results in a less strong increase in the shear force towards the supporting wall. The mentioned suspension element is a part of the carrier component and is configured as an eyelet or a hook, for example. The carrier component has exactly just one suspension element. Thus, the suspension means is fixed directly to the carrier component. Moving the suspension element can be implemented very easily, thereby allowing a simple and cost-effective implementation of a compensating element.

In particular, a suspension member is arranged between the suspension means and the carrier component. The suspension means and the suspension member are connected via a connecting element. The suspension means is thus fixed to the carrier component via the suspension member, so that the suspension means is indirectly fixed to the carrier component. The compensating element is configured and arranged in such a way that when the first distance between the deflection roller and the mounting apparatus decreases, a fourth distance between the connecting element and the supporting decreases. Thus, the position of the connecting element is changed with respect to the suspension member. Decreasing the fourth distance counteracts the increase in the diagonal pull of the suspension means in the direction of the supporting wall, which, as described above, results at least in a less strong increase of the shear force towards the supporting wall. The suspension member is configured, for example, as a cable sling which is fixed at both ends to the carrier component. Such a cable sling can also be referred to as a so-called hanger. The connecting element of the suspension member is configured, for example, as an eyelet which can be moved along the cable sling and thus the distance between the eyelet and the supporting wall can be changed.

The compensating element includes in particular at least one energy storage which acts on the displacement component, the deflection element or the suspension element with a force in a direction perpendicular to the supporting wall of the elevator shaft. The above-described horizontal component of the holding force on the carrier component must be supported by the displacement component or the deflection element or acts on the suspension element. The energy storage is arranged and configured in such a way that changing the horizontal component of the holding force results in a displacement of the displacement component, the deflection element or the suspension element, which, as described above, counteracts an increase in the diagonal pull of the holding means towards the supporting wall. By suitably designing the energy storage, which can be done by calculations or simple tests, a desired diagonal pull of the holding device towards the supporting wall can be achieved. Thus, the compensating element can be implemented very easily and without controllable actuators. It is therefore very cost-effective and hardly prone to error.

The energy storage can, be configured, for example, as a spring which acts in the above-mentioned direction on the displacement component, the deflection element or the suspension element. The energy storage can also be configured as an air or hydraulic accumulator, for example. It is also possible that on opposite sides of the displacement component, the deflection element or the suspension element in each case one energy storage is arranged, which apply a force from both sides.

The compensating element can also include at least one actuator that is configured and arranged such that it is able to displace the displacement component, the deflection element, the suspension element or the connecting element in a direction perpendicular to the supporting wall of the elevator shaft. This allows an exact adjustment of the distance of the above-mentioned components with respect to the supporting wall and thus an exact adjustment of the diagonal pull of the suspension means with respect to the supporting wall and thus of the horizontal component of the shear force in the direction of the supporting wall. Tilting of the carrier component about the upper support roller towards the supporting wall can thus be safely prevented.

The actuator can be, for example, of electrical, hydraulic or pneumatic design and can include a movable positioning cylinder which is coupled to the displacement component, the deflection element, the suspension element or the connecting element. In particular, the mounting system has a control device that is provided for suitably controlling the actuator. In particular, said control device also controls further actuators of the mounting system, such as the displacement component.

In an embodiment of the invention, the compensating element is configured and arranged in such a way that it increases a fifth distance of a center of gravity of the mounting apparatus from the supporting wall when the first distance between the deflection roller and the mounting apparatus decreases. For this purpose, the compensating element includes in particular an actuator which can displace a balancing weight. By increasing the fifth distance between the center of gravity of the mounting apparatus and the supporting wall, as mentioned, the carrier component is prevented from tilting around the upper support roller towards the supporting wall even if the horizontal component of the holding force towards the supporting wall increases. By increasing the fifth distance, as mentioned, the torque about the upper support roller generated by the weight of the mounting apparatus increases, which counteracts the counteracting torque generated by the horizontal component of the holding force in the direction of the supporting wall. The increase in the horizontal component of the holding force towards the supporting wall caused by a greater diagonal pull of the holding means towards the supporting wall can thus be compensated.

In this embodiment of the mounting system, a small, light and inexpensive actuator can be used for the compensating element, since the balancing weight is not under load during displacement, thus can be displaced with a very small actuating force.

The mounting system includes in particular a control device that is provided for suitably controlling the actuator. In particular, the aforementioned control device also controls further actuators of the mounting system, such as the displacement component.

The mechatronic installation component is in particular part of the compensating element and increasing the fifth distance is carried out by changing the position of the mechatronic installation component. Therefore, no additional balancing weight and no additional actuator is required, which allows for a particularly light and cost-effective mounting apparatus.

The mechatronic installation component can be configured, for example, as an industrial robot with a robot arm.

Before displacing the mounting apparatus, the robot arm is brought as close as possible to the supporting wall. During the displacement of the mounting apparatus, thus during the reduction of the aforementioned first distance, the robot arm is then moved further and further away from the supporting wall, whereby the center of gravity is also moved away from the supporting wall, thus increasing the aforementioned fifth distance. In order to achieve the greatest possible displacement of the center of gravity of the mounting apparatus, the industrial robot can pick up additional parts, such as components to be mounted, before the displacement, thereby increasing the weight to be moved during the displacement. For this purpose, the mounting system has a control device that is provided for controlling the mechatronic installation components accordingly.

The fifth distance is adjusted in particular depending on the first distance between the deflection roller and the mounting apparatus or on the inclination of the carrier component. Thus, a suitable adjustment of the fifth distance is always possible and thus a suitable adjustment of the distance of the center of gravity of the mounting apparatus to the supporting wall. Tilting of the carrier component about the upper support roller towards the supporting wall can thus be prevented particularly safely. With regard to the detection of the first distance and/or the aforementioned inclination, as well as to the evaluation of the variables, the above explanations apply accordingly.

In an embodiment of the invention, the compensating element includes a force transmission point at which the holding force applied by the displacement component via the suspension means is introduced into the carrier component, and the upper support roller, the force transmission point being arranged at the same height as or below the upper support roller, in particular an axis of rotation of the upper support roller. For this purpose, the upper support roller can be arranged, for example, on a spacer element projecting upwards from the carrier component.

In this case, the spacer element is not a separate component, but is composed of a combination of components of the carrier component which are arranged to each other in a specific manner. Thus, the compensating element can be implemented in a particularly cost-effective manner. The force transmission point is in particular the point at which a suspension element, for example in the form of a hook or an eyelet, at which the suspension means is suspended, is fixed to the carrier component. The suspension element can also be part of the carrier component or be formed by the carrier component; for example, the suspension element can be configured as a through-opening in the carrier component into which the suspension means can be hooked in. In this case, the force transmission point is the point of contact between the suspension means and the carrier component. In particular, the suspension element can also be regarded as part of the compensation element.

In the described arrangement of the force transmission point opposite the upper support roller, the horizontal component of the holding force in the direction of the supporting wall cannot result in a torque about the upper support roller that is oriented such that the carrier component could tilt towards the supporting wall. Thus, tilting of the carrier component towards the supporting wall can be avoided in a particularly simple and cost-effective manner. The arrangement of the force transmission point with respect to the upper support roller again refers to the functional condition of the mounting system already mentioned above. In the case of a direct connection between the suspension means and the carrier component, the force transmission point is located at the above-mentioned suspension element. If a suspension member is arranged between the suspension means and the carrier component, this results in at least two force transmission points, namely at the connection points between the suspension element and the carrier component. This plurality of force transmission points is usually situated at the same height. If this is not the case, all force transmission points should be arranged at the same height or below the upper support roller.

The different embodiments of the compensating element can be combined with each other.

Further advantages, features and details of the invention arise from the following description of exemplary embodiments as well as from the drawings, in which identical or functionally identical elements are provided with identical reference signs. The drawings are only schematic and not true to scale.

DETAILED DESCRIPTION

Figure 1:
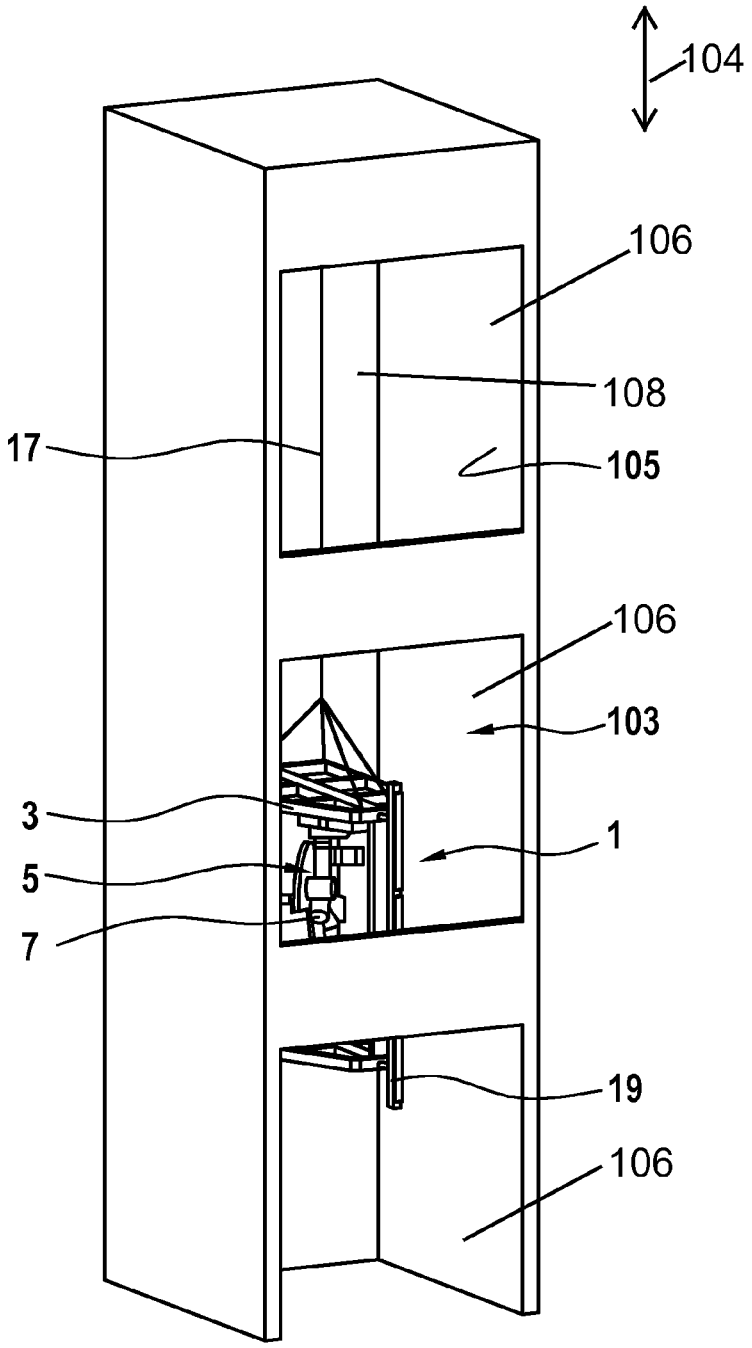
FIG. 1 shows a perspective view of a mounting system for performing an installation operation in an elevator shaft of an elevator system in a functional condition.

FIG. 1 shows an elevator shaft 103 of an elevator system in which a mounting system 1 is arranged. The mounting system 1 has a mounting apparatus 5 with a carrier component 3 and a mechatronic installation component 7. The carrier component 3 is configured as a frame on which the mechatronic installation component 7 is mounted. This frame has dimensions that enable the carrier component 3 to be displaced vertically within the elevator shaft 103, thus along the perpendicular or vertical 104, that is, to move it to different vertical positions on different floors within a building, for example. The mechatronic installation component 7 is configured in the form of an industrial robot that is attached hanging downwards from the frame of carrier component 3. One arm of the industrial robot can be moved relative to the carrier component 3 and, for example, can be displaced towards or away from a shaft wall 105 of the elevator shaft 103.

The carrier component 3 is connected via a steel cable serving as suspension means 17 to a displacement component 15 (see FIG. 2) in the form of a motor-driven cable winch which is hidden in FIG. 1 and therefore not visible (see FIG. 2) and which is attached at the top in the elevator shaft 103 to a shaft ceiling 107 (see FIG. 2) of the elevator shaft 103. Between the displacement component 15 and the carrier component 3, the suspension means 17 is guided via a deflection roller 34 (see FIG. 2) which is hidden in FIG. 1 and is therefore not visible. By means of the displacement component 15, the mounting apparatus 5 can be displaced vertically within the elevator shaft 103 over the entire length of the elevator shaft 103.

The mounting apparatus 5 further includes a fixing component 19, by means of which the carrier component 3 can be fixed within the elevator shaft 103 in a lateral direction, that is, in a horizontal direction. The fixing component 19 on the front side of the carrier component 3 and/or the pad (not shown) on a rear side of carrier component 3 can be moved outwards to the front or rear for this purpose and thus fix the carrier component 3 in place between walls 105 of the elevator shaft 103.

The industrial robot can be coupled at its cantilevered end with various mounting tools, which are not shown in more detail. The mounting tools can differ in their design and their intended use. With these mounting tools, mounting steps can be performed semi-automatically or fully automatically in a fixed state of the mounting apparatus.

Furthermore, a magazine component, which is not shown in detail, can be provided on the carrier component 3. The magazine component can be used to store components to be installed and to provide them to the industrial robot 7. For example, the magazine component can accommodate various components, in particular in the form of different profiles, which are to be mounted on the shaft walls 105 within the elevator shaft 103, for example to be able to attach guide rails for the elevator system thereon. The magazine component can also be used to store and provide screws that can be screwed into prefabricated holes in the shaft wall 105 with the aid of the industrial robot 7.

Furthermore, support rollers, which are not shown in FIG. 1 (upper support rollers 21 and lower support rollers 22 in FIG. 2), are provided on the carrier component 3, by means of which support rollers the carrier component 3 is guided during vertical displacement within the elevator shaft 103 along a shaft wall denoted hereinafter as supporting wall 108. The supporting wall 108 is the shaft wall that is located opposite to door openings 106 of the elevator shaft 103. During the displacement of the mounting apparatus 5, the support rollers roll on the supporting wall 108. Depending on the arrangement of the support rollers on the carrier component, one to four support rollers, in particular, can be provided.

Figure 2:
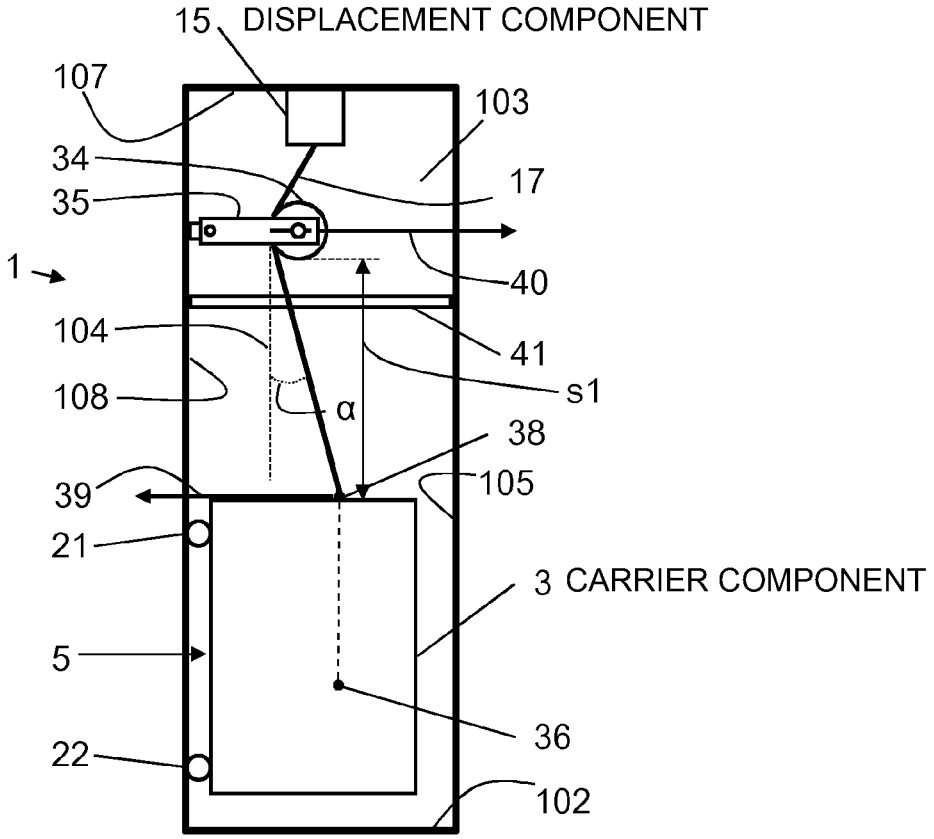
FIG. 2 shows a side view of a mounting system with a deflection roller between a displacement component and a carrier component.

FIG. 2 shows a side view of the mounting apparatus 1, wherein only the carrier component 3, the upper support rollers 21 and the lower support rollers 22 are shown of the mounting apparatus 5. The displacement component 15 is suspended from the shaft ceiling 107. The shaft ceiling 107, the shaft walls 105 and a shaft floor 102 define the elevator shaft 103 and can be designated as boundary surfaces of the elevator shaft 103.

The suspension means 17 runs downwards from the displacement component 15, via a deflection roller 34, to a suspension point 38 of the suspension means 17 on the carrier component 3. The suspension point 38 is located exactly above a center of gravity 36 of the mounting apparatus 5. The suspension means 17 first runs inclined with respect to the vertical 104 from the displacement component 15 towards the supporting wall 108 and is then deflected by the deflection roller 34 in such a way that after the deflection roller 34, it runs inclined away from the supporting wall 108. A displacement of the deflection roller 34 in horizontal or vertical direction changes the deflection and thus the direction of the suspension means 17.

The suspension means 17 thus has a diagonal pull $\alpha$ between the deflection roller 34 and the carrier component 3 in the direction of the supporting wall 108. The mentioned diagonal pull $\alpha$ corresponds to the angle that the suspension means 17 forms with the perpendicular or vertical 104 in the direction of the supporting wall 108. Due to the diagonal pull $\alpha$, a holding force acting on the carrier component 3 via the suspension means 17 has a horizontal component 39 in the direction of the supporting wall 108. The horizontal component 39 causes a horizontal reaction force 40 in the opposite direction at the deflection roller 34.

Below the deflection roller 34, an installation platform 41 is arranged in the elevator shaft 103 in such a way that an installer is able to install the deflection roller 34 and the displacement component 15 from the installation platform 41. In particular, the displacement component 15 is suspended from the shaft ceiling 107 by a suspension device that is not shown here and that is already provided during the construction of the elevator shaft 103. The deflection roller 34 is fixed to the supporting wall 108 via a holding apparatus 35 in such a way that it protrudes into the elevator shaft 103. The installation of the deflection roller 34 is explained in more detail in connection with FIG. 3.

The carrier component 3 has a pair of upper support rollers 21 and a pair of lower support rollers 22. The upper support rollers 21 are arranged in an upper region and the lower support rollers 22 are arranged in a lower region of carrier component 3. The upper support rollers 21 are arranged below the suspension point 38 at which the carrier component 3 is suspended from the suspension means 17. The suspension point 38 is at the same time also a force transmission point at which the holding force is introduced from the suspension means 17 into the carrier component 3. The carrier component 3 is supported on the supporting wall 108 via the support rollers 21, 22. If the diagonal pull $\alpha$ of the supporting means 17 in the direction of the supporting wall 108 and thus the horizontal component 39 of the holding force of the carrier component 3 becomes too large, tilting of the carrier component 3 about the upper support rollers 21 can occur. In order to counteract the increase of the diagonal pull $\alpha$ in the direction of the suspension means 17 between the deflection roller 34 and the carrier component 3 when a first distance s1 between the deflection roller 34 and the carrier component 3 decreases, a compensating element 24, shown in FIG. 3, is arranged on the holding apparatus 35 of the deflection roller 34.

Figure 3:
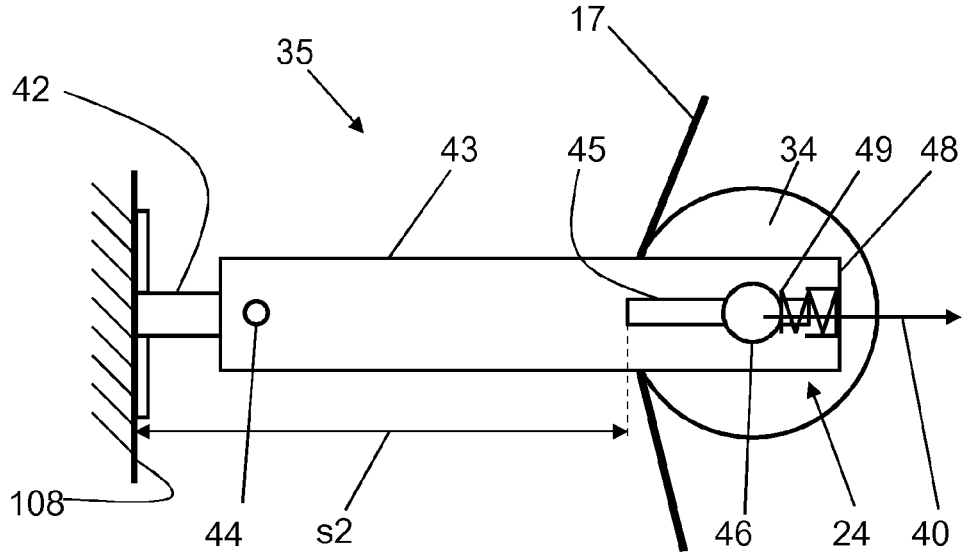
FIG. 3 shows the deflection roller with a compensating element on a holding apparatus in an enlarged view.

According to FIG. 3, the holding apparatus 35 has a fixing part 42 and a pivot arm 43. The fixing part 42 is screwed to the supporting wall 108 via screws, which are not shown. The fixing part has a cylindrical recess, which is not visible in FIG. 3, into which a bolt 44 is inserted via which the pivot arm 43 is pivotally connected to the fixing part 42. The pivot arm 43 can be pivoted about the bolt 44 so that the bolt 44 forms a pivot axis of the pivot arm 43. The bolt 44 and thus the pivot axis runs horizontally and parallel to the supporting wall 108. In FIG. 3, the pivot arm 43 is aligned horizontally and is held in this position by the suspension means 17.

The pivot arm 43 has an elongated hole 45 which is aligned in a main direction of extent of the pivot arm 43 and thus horizontally in FIG. 3. One axis 46 of the deflection roller 34 runs through the slot 45 and is aligned parallel to the bolt 44. The axis 46 can be moved in the slot 45 relative to the pivot arm 43 and thus horizontally in FIG. 2. Therefore, a second distance s2 between the deflection roller 34 and the supporting wall 108 can be changed, thus increased or decreased. Between an end 48 opposite the fixing part 42 and the axis 46, a coil spring 49 is arranged in such a way that it applies a force to the axis 46 and thus to the deflection roller 34 in the direction of the supporting wall 108.

When the carrier component 3 is pulled upwards in the elevator shaft 103, the first distance s1 between the deflection roller 34 and the carrier component 3 decreases. As a result, the horizontal component 39 of the holding force and thus also the reaction force 40 increases. Thereby, the deflection roller 34 including axis 46 is moved away from the supporting wall 108 against the force of the coil spring 49, thus the second distance s2 is increased. The compensating element 24 thus counteracts an increase in the diagonal pull $\alpha$ of the suspension means 17 when the first distance s1 between the deflection roller 34 and the carrier component 3 decreases.

It is also possible that no compensating element is arranged on the holding apparatus. In this case, the axis of the deflection roller is fixed at a fixed position within the slotted hole of the pivot arm, for example by means of suitable nuts. In this case, the diagonal pull of the suspension means at a certain position of the support element can be adjusted, for example, during installation of the deflection roller, by determining the position of the axis of the deflection roller.

Figure 4:
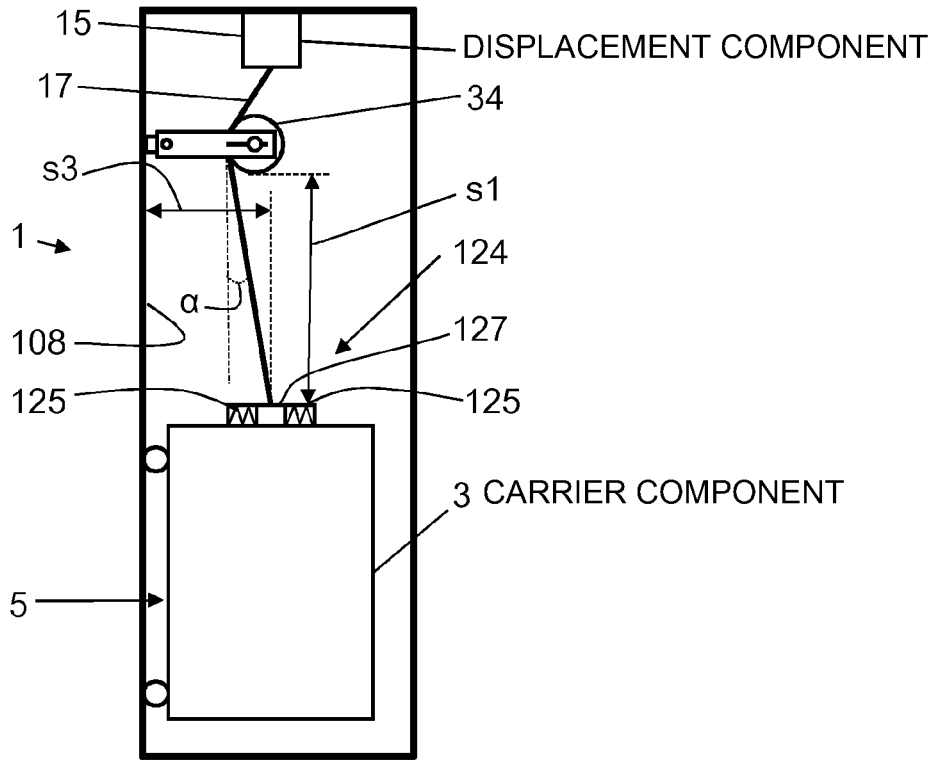
FIG. 4 shows a side view of a mounting system with a compensating element in a second exemplary embodiment.

In the mounting system 1 according to FIG. 4, a compensating element 124 is located at the top of carrier component 3. The suspension means 17 is fixed to the carrier component 3 via a suspension element 127 which can be moved in a vertical direction to the supporting wall 108. The compensating element 124 has two springs 125 which are arranged on opposite sides of the suspension element 127 with respect to the supporting wall 108 and thus each of them exerts a holding force on the suspension element 127. The ends of the springs 125 opposite to the suspension element 127 are fixed stationarily with respect to the carrier component 3 in a manner not shown in more detail. The suspension element 127 has a third distance s3 from the supporting wall 108.

If the mounting apparatus 5 is now displaced upwards and thus the first distance s1 between deflection roller 34 and mounting apparatus 5 decreases, the horizontal component of the holding force on the carrier component 3 increases and the suspension element 127 is pressed towards the supporting wall 108 and displaced against the force of the springs 125 towards the supporting wall 108. Thus, the mentioned third distance s3 decreases. This displacement of the suspension element 127 in turn counteracts the increase in the diagonal pull $\alpha$ of the suspension means 17 in the direction of the supporting wall 108. In doing so, an equilibrium is continuously established, which is mainly determined by the characteristics of the springs 125. By means of calculations or simple tests, the springs 125 can be designed in such a way that tilting of the mounting apparatus 5 can be reliably avoided.

Figure 5:
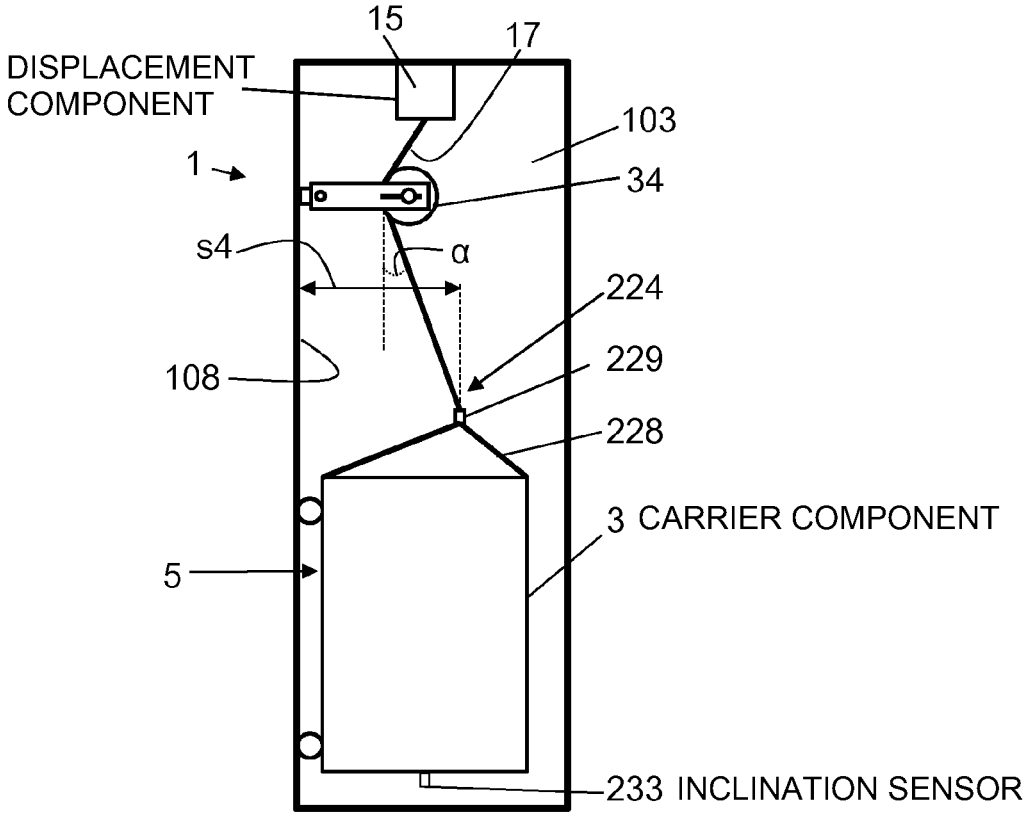
FIG. 5 shows a side view of a mounting system with a compensating element in a third exemplary embodiment.
Figure 6:
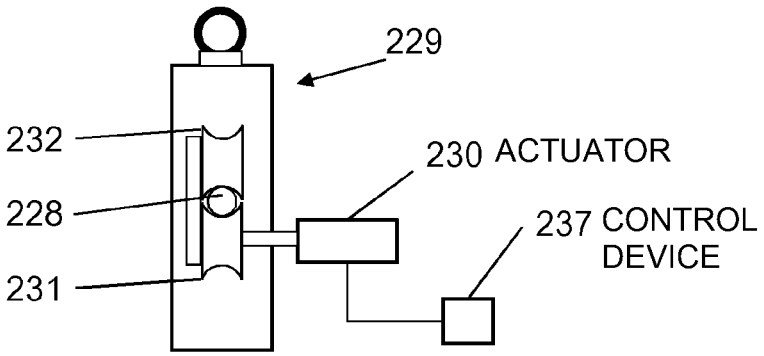
FIG. 6 shows the compensating element in the third exemplary embodiment in a more detailed view.

In the mounting system 1 according to FIG. 5, a suspension member 228 is arranged between the suspension means 17 and the carrier component 3, wherein the suspension means 17 and the suspension member 228 are connected via a connecting element 229. The suspension member 228 is designed as a cable sling, the ends of which are connected to the carrier component 3 on opposite sides with respect to the supporting wall 108. A compensating element 224 is arranged on the suspension member 228 and is configured such that it is able to move the connecting element 229 relative to the suspension member 228. For this purpose, the compensating element 224 is equipped with an actuator 230 in the form of an electric motor, which is only shown in FIG. 6 and by means of which the connecting element 229 can be moved relative to the suspension member 228. The actuator 230 can drive a drive roller 231. The suspension member 228 runs between the drive roller 231 and a pressure roller 232. The pressure roller 232 is pressed against the suspension member 228 and the suspension member is pressed against the drive roller 231 by means of a spring, which is not shown in FIG. 6. When the actuator 230 now drives the drive roller 231, the drive roller rolls on the suspension member 228, which allows the position of the connecting element 229 and thus a fourth distance s4 to the supporting wall 108 to be adjusted with respect to the suspension member 228.

The actuator 230 is controlled by a control device 237. The control device 237 adjusts the mentioned fourth distance as a function of an inclination of the carrier component 3. An inclination sensor 233 is installed at the bottom of the carrier component 3 to measure the inclination. The control device 237 measures the inclination and adjusts the fourth distance by means of a feedback control in such a way that the carrier component 3 is always vertically aligned, thus has no inclination. It is also possible that the control device 237 adjusts the fourth distance s4 as a function of the first distance s1 between the deflection roller 34 and the mounting apparatus 5. For this purpose, the control device 237 can measure the first distance directly by means of a distance sensor, which is not shown. It is also possible that the control device measures a distance to a floor of the elevator shaft 103 and determines the first distance therefrom. Furthermore, it is possible that the control device 237 detects how far the displacement component 15 displaces the mounting apparatus 5 in the elevator shaft 103 and determines the current first distance based on a first distance before the displacement. To determine the currently required fourth distance, a table is stored in the control device 237, in which table the fourth distance is stored as a function of the first distance. When the control device 237 has determined the current first distance, it can read out the currently required fourth distance from the table mentioned above and then adjust the distance with the help of the actuator 230.

Figure 7:
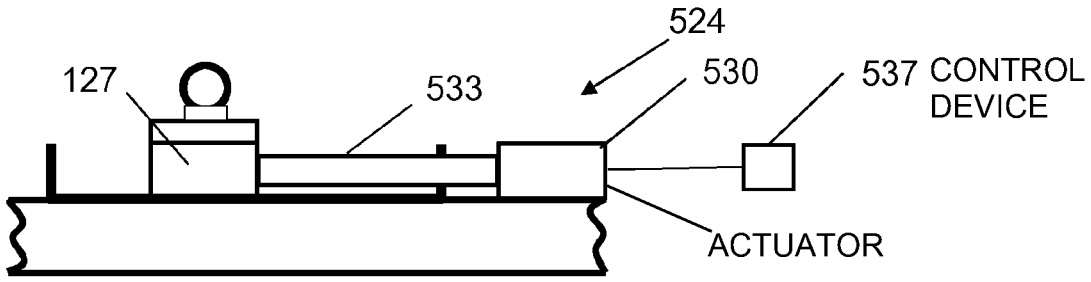
FIG. 7 shows a compensating element in a fourth exemplary embodiment.

In FIG. 7, an alternative compensating element 524 to the compensating element 124 of FIG. 4 is illustrated. Instead of a spring, the compensating element 524 has an actuator 530 by means of which the suspension element 127 can be moved. The actuator 530 is configured as an electric motor which can extend and retract a positioning cylinder 533 acting on the suspension element 127. The actuator 530 is controlled by a control device 537, analogous to the actuator 230 in FIG. 6.

Figure 8:
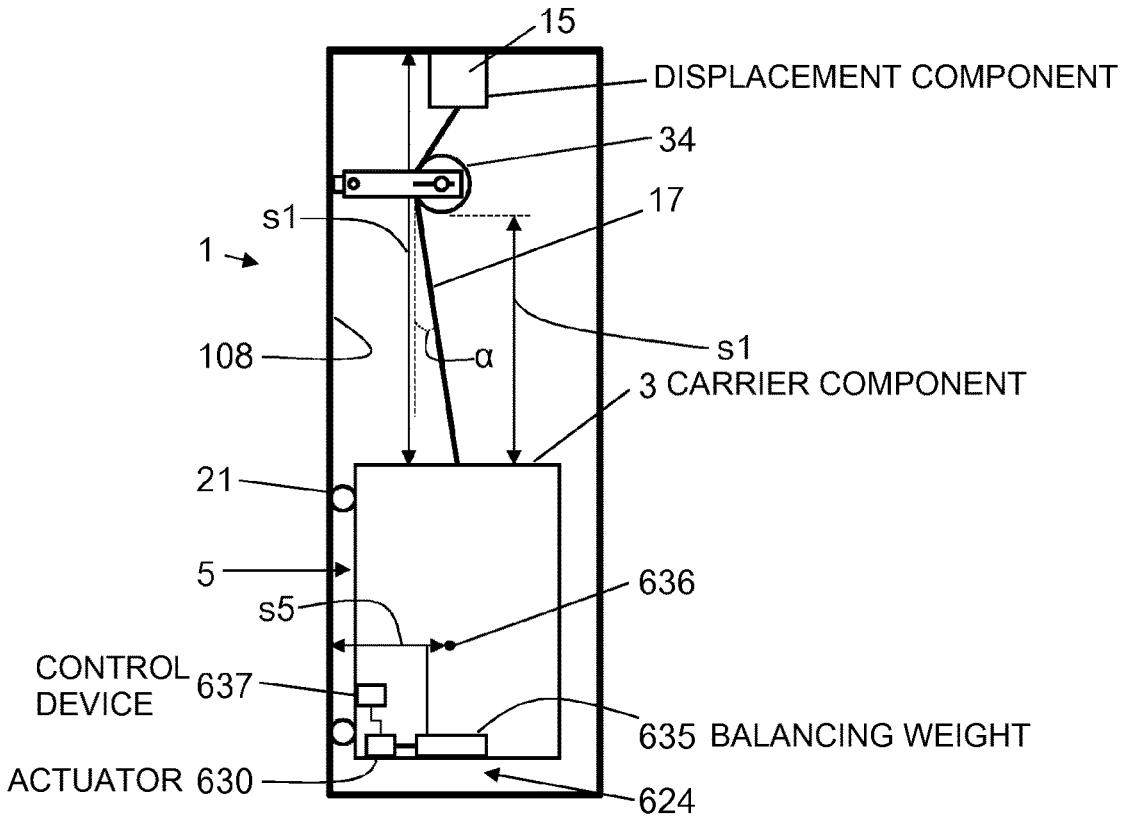
FIG. 8 shows a side view of a mounting system with a compensating element in a fifth exemplary embodiment.

The mounting system 1 according to FIG. 8 is structured very similar to the mounting system 1 according to FIG. 2, so that only the differences are discussed. To prevent the carrier component 3 from tilting about the upper support roller 21 in the direction of the supporting wall 108, the mounting system 1 has a compensating element 624. The compensating element 624 includes an actuator 630 connected to a balancing weight 635. The balancing weight 635 can be displaced relative to the carrier component 3 mainly in horizontal direction by means of the actuator 630. By moving the balancing weight 635, a center of gravity 636 of the mounting apparatus 5 can be moved and thus a fifth distance s5 of the center of gravity 636 to the supporting wall 108 can be changed or adjusted. The actuator 630 is controlled by a control device 637 in such a way that upon decreasing the first distance between the deflection roller 34 and the mounting apparatus 5, the fifth distance s5 of the center of gravity 636 of the mounting apparatus 5 to the supporting wall 108 is increased. The actuator 630 is controlled analogously to the actuator 230.

Figure 9:
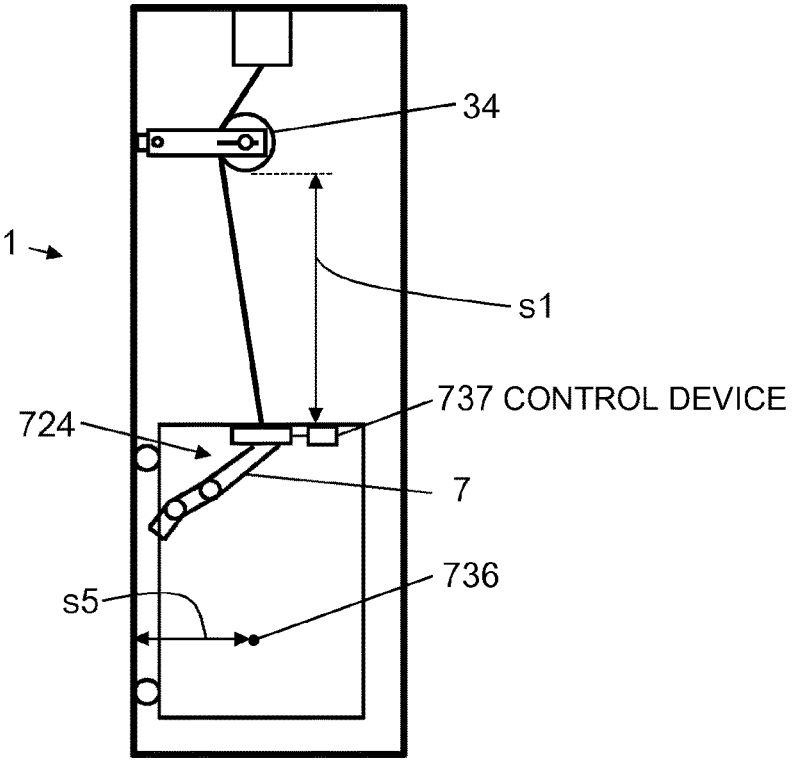
FIG. 9 shows a side view of a mounting system with a compensating element in a sixth exemplary embodiment and FIG. 10 shows a side view of a mounting system with a compensating element in a seventh exemplary embodiment.

The mounting system 1 according to FIG. 9 includes a compensating element 724 which basically functions in the same way as the compensating element 624 in FIG. 8. The difference is that in the mounting system 1 according to FIG. 9, the mechatronic installation component 7 in the form of the industrial robot is part of the compensating element 724 and is used as a balancing weight. In this case, the center of gravity 736 is moved by changing the position of the mechanical installation component 7 controlled by a control device 737.

Figure 10:
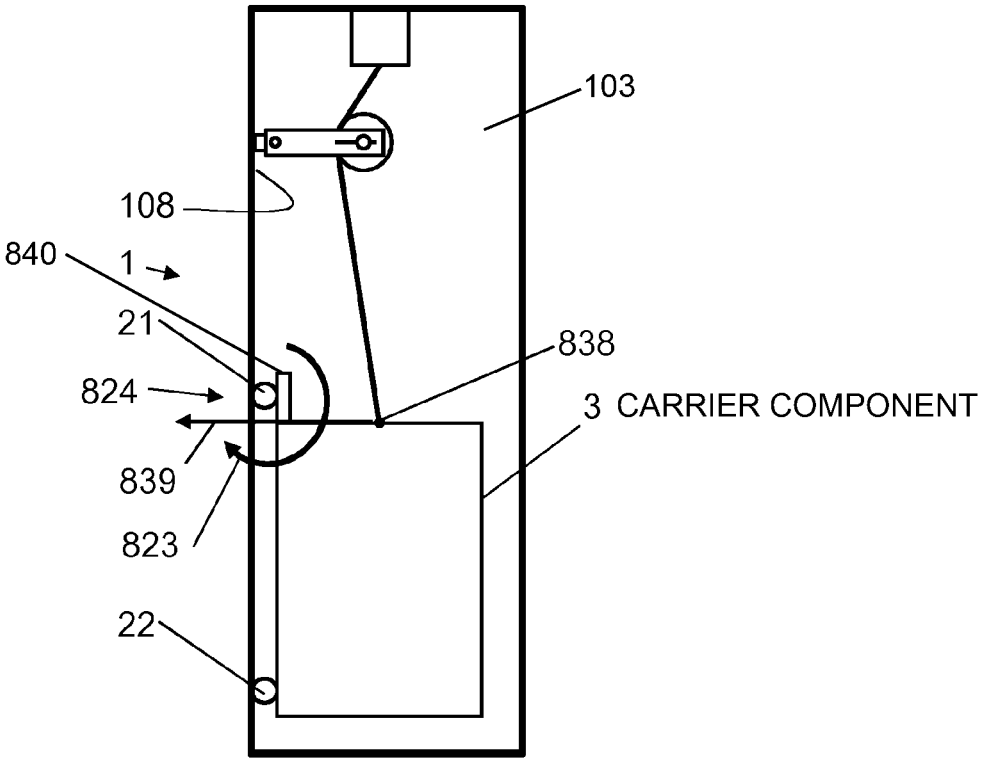

In the mounting system 1 according to FIG. 10, the upper support roller 21 is arranged on a spacer element 840 protruding upwards from the carrier component 3. A force transmission point 838, at which the holding force is introduced into the carrier component 3, is thus arranged below the upper support roller 21, in particular below an unmarked axis of rotation of the upper support roller 21. It would also be possible for the force transmission point to be arranged at the same height as the upper support roller. Thus, the horizontal component 839 of the holding force runs below the support roller 21. The torque 823 generated in this manner therefore cannot result in the lower support roller 22 lifting off from the supporting wall 108 and thus causing the carrier component 3 to tilt about the upper support roller 21. Rather, the lower support roller 22 is pressed against the supporting wall 108 by the torque 823. The upper support roller 21, the spacer element 840 and the force transmission point 838 thus form a compensating element 824 which counteracts the tilting of the carrier component 3 about the upper support roller 21 in the direction of supporting wall 108 during the displacement of carrier component 3 in the elevator shaft 103. In addition to the above-mentioned components, the compensating element can also include a suspension element, which is not shown, for example in the form of an eyelet, a hook or a through-hole of the carrier component.

Finally, it is be noted that terms such as "including", "comprising" etc. do not exclude other elements or steps, and terms such as "a" or "one" do not exclude a plurality. It should also be noted that features or steps described with reference to one of the above exemplary embodiments can also be used in combination with other features or steps of other exemplary embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A mounting system for performing an installation operation in an elevator shaft of an elevator system, the mounting system comprising:

a mounting apparatus having a carrier component and a mechatronic installation component mounted on the carrier component;

a displacement component arranged above the mounting apparatus in the elevator shaft;

a suspension means fixed at least indirectly to the carrier component and connecting the carrier component to the displacement component;

a deflection roller fixed in the elevator shaft and deflecting the suspension means between the displacement component and the carrier component;

wherein the displacement component displaces the carrier component in a vertical direction in the elevator shaft using the suspension means;

wherein the carrier component is supported on a supporting wall of the elevator shaft by an upper support roller at least during a displacement of the carrier component in the elevator shaft;

wherein the suspension means exerts, between the deflection roller and the carrier component, a diagonal pull with respect to the vertical direction toward the supporting wall;

wherein the suspension means is guided by the deflection roller such that the diagonal pull can be varied by displacing the deflection roller relative to the supporting wall; and wherein the deflection roller is arranged by a holding apparatus on a boundary surface of the elevator shaft and protrudes into the elevator shaft.

2. The mounting system according to claim 1 wherein the boundary surface is the supporting wall and the deflection roller is fixed to the supporting wall by the holding apparatus.

3. The mounting system according to claim 1 wherein at least a part of the holding apparatus is arranged on the boundary surface of the elevator shaft and is pivotable about a pivot axis, and wherein the pivot axis runs in a horizontal direction and parallel to the boundary surface.

4. The mounting system according to claim 3 wherein the holding apparatus has a fixing part and a pivot arm, the fixing part is fixed to the boundary surface, the deflection roller is arranged on the pivot arm and the pivot arm is pivotable relative to the fixing part.

5. The mounting system according to claim 1 wherein the displacement component is suspended from a shaft ceiling of the elevator shaft.

6. The mounting system according to claim 1 wherein a suspension point at which the suspension means is fixed on the carrier component is arranged vertically above a center of gravity of the mounting apparatus.

7. The mounting system according to claim 1 including a compensating element arranged in the elevator shaft to counteract a tilting of the carrier component about the upper support roller toward the supporting wall during the displacement of the carrier component in the elevator shaft.

8. The mounting system according to claim 7 wherein the compensating element is adapted to counteract an increase in the diagonal pull of the suspension means when there is a decrease in a distance between the deflection roller and the carrier component as the carrier component is displaced in the elevator shaft.

9. The mounting system according to claim 7 wherein the compensating element is arranged on the holding apparatus.

10. The mounting system according to claim 7 wherein in response to a decrease in a distance between the deflection roller and the carrier component the compensating element increases a distance of the deflection roller from the supporting wall.

11. The mounting system according to claim 7 wherein the compensating element includes a spring arranged to apply a force to the deflection roller in a direction of the supporting wall.

12. The mounting system according to claim 7 wherein the compensating element is arranged on the carrier component and, in response to a decrease in a distance between the deflection roller and the carrier component, decreases a distance of a suspension element on the carrier component from the supporting wall, the suspension element connecting the carrier component to the suspension means.

13. The mounting system according to claim 7 wherein the compensating element, in response to a decrease in a distance between the deflection roller and the carrier component, increases a distance of a center of gravity of the mounting apparatus from the supporting wall.

14. The mounting system according to claim 7 wherein the compensating element includes a force transmission point at which a holding force is introduced into the carrier component, and the force transmission point is arranged at a same height as or below the upper support roller.

* * * * *